United States Patent [19]

Chau

[11] Patent Number: 4,639,144

[45] Date of Patent: Jan. 27, 1987

[54] NOVELTY WRIST WATCH

[75] Inventor: Jacky Chau, Hong Kong, Hong Kong

[73] Assignee: Big Time, Inc., West Hemstead, N.Y.

[21] Appl. No.: 809,388

[22] Filed: Dec. 16, 1985

Related U.S. Application Data

[63] Continuation-in-part of Ser. No. 750,918, Jul. 1, 1982, Pat. No. Des. 285,288.

[51] Int. Cl.[4] ..... G04B 37/00; A44C 5/18

[52] U.S. Cl. ..... 368/276; 368/282; 24/265 WS; 224/164

[58] Field of Search ..... 368/276, 280, 281, 282; 224/164–175; 24/265 WS

[56] References Cited

U.S. PATENT DOCUMENTS

| | | | |
|---|---|---|---|
| 1,264,650 | 4/1918 | Ruelas | 368/281 |
| 1,486,608 | 3/1924 | Schroeder | 368/72 |
| 2,224,421 | 12/1940 | Aaron | 368/276 |
| 3,968,640 | 7/1976 | Clemmer et al. | 368/82 |
| 3,977,176 | 8/1976 | Murakami et al. | 368/280 |
| 3,992,870 | 11/1976 | Dekel | 368/276 |
| 4,291,402 | 9/1981 | Nakajima et al. | 368/276 |
| 4,391,533 | 7/1983 | Waki | 368/276 |
| 4,462,697 | 7/1984 | Thompson | 368/282 |

FOREIGN PATENT DOCUMENTS

| | | | |
|---|---|---|---|
| 48119 | 7/1909 | Switzerland | 368/282 |
| 82107 | 9/1919 | Switzerland | 24/265 WS |
| 111404 | 8/1925 | Switzerland | 368/282 |

*Primary Examiner*—Vit W. Miska

*Attorney, Agent, or Firm*—Natter & Natter

[57] ABSTRACT

A novelty wrist watch includes an enlarged digital display, a printed circuit board carrying timing and display driving circuitry and a power supply, all of which are carried in a two part molded plastic case. An upper case section carries and frames the digital display and a lower case section carries the board and power supply. Extending parallel to and spaced from the ends of the lower case section is a strap retainer which is joined to the side edges of the lower case. The lower case together with the strap retainers are unitarily formed of one piece. A one piece wrist watch strap is threaded through the space between each retainer and its respective case end and beneath the bottom of the lower case.

20 Claims, 8 Drawing Figures

FIG. 6
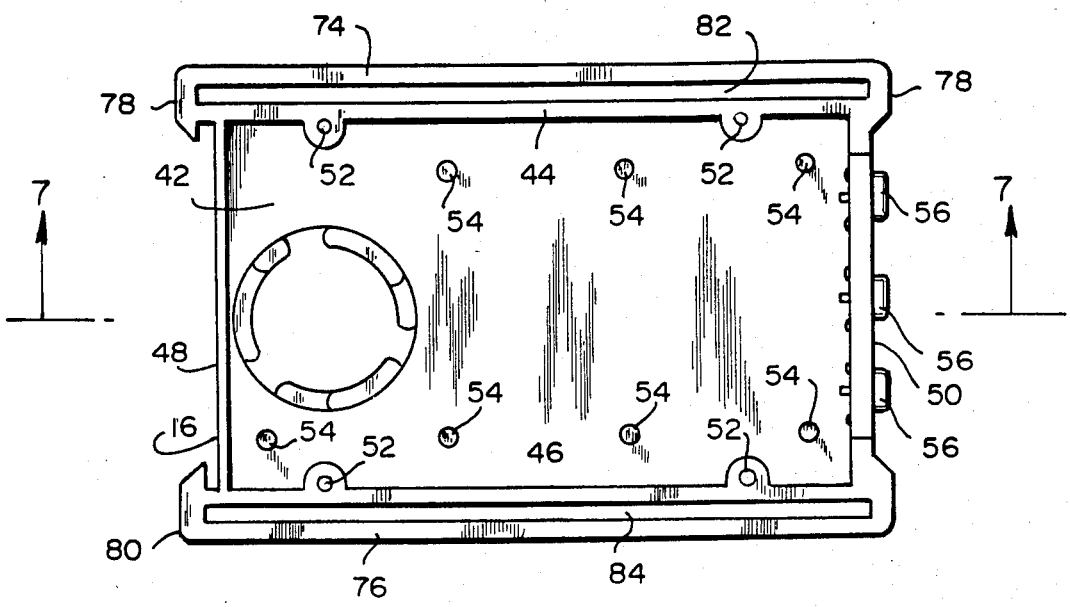
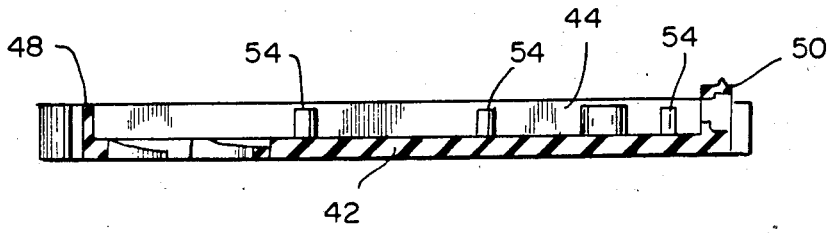
FIG. 7
FIG. 8
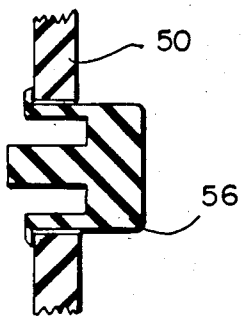

NOVELTY WRIST WATCH

RELATED APPLICATIONS

This is a continuation-in-part of application Ser. No. 6/750,918 filed July 1, 1985 entitled Wrist Watch, now U.S. Pat. No. Des. 285,288.

FIELD OF THE INVENTION

This invention relates generally to timepieces and more particularly to a novelty wrist watch having a plastic case.

BACKGROUND ART

The wrist watch industry has undergone major upheavals in the past decade with the advent of advanced quartz timing circuitry and digital displays. The demise of the traditional jewelled wrist watch movement commenced with the introduction of the digital watch having light emitting diode displays. A major inconvenience of such display systems was their relatively large power draw which required the use of a switch to prevent display illumination except when one actuated the switch.

Generally, thc electronic timing circuitry included an oscillating quartz crystal. Advances in display technology resulted in the implementation of liquid crystal displays which required less power than the light emitting diodes and which remained on for the duration of battery life.

Further advances included multiple features such as simultaneous timekeeping in multiple time zones, stopwatch, lap timing, beep and even musical alarms.

Thereafter, a resurgency in the use of analog displays for wrist watches occurred, with the analog timepieces being driven by the quartz electronics. Then, low cost plastic watch cases came into vogue and it became fashionable to have several watches in several colors with matching or contrasting watch bands. The style conscious people owned many of the novelty plastsic cased timepieces for color choice coordination with a selected wardrobe.

The present invention is addressed to utilizing a liquid crystal battery-powered clock-size display, e.g., 4 cm. in width by 2 cm. in height, as a novelty watch having an appropriate securement for a compatibly wide wrist strap. The use of a plastic case and the unique rectangular plan configuration of the timepiece presented problems. If adhesive securement were employed, construction became time-consuming and it was difficult if not impossible to replace a strap. Because of the case size conventional spring loaded pins would not fit and were incompatible. In addition it was evident that if separate spring loaded pins were employed, they would not withstand the rigors of sustained usage in a shock prone environment such as sports activities.

A SUMMARY OF THE INVENTION

A wrist watch case is formed of an upper and a lower case section, each of which is molded of one piece thermoplastic. Attached to the case is a wrist watch strap which is threaded under the bottom of the lower section and over a pair of strap retainers which extend parallel to the case ends and through spaces formed between the retainers and the ends of the case.

The upper case section carries an enlarged rectangular digital display while the lower case section carries a printed circuit board and a power supply. The strap retainers are spaced from the ends of the lower case segment by a pair of integral legs which are joined, in one piece construction to the sides of the lower case section. The retainer material and dimensions are such as to provide sufficient flexibility to enlarge the space between the retainers and the ends of the case for threading portions of the watch strap such as buckles or snaps to permit easy and simplified changing of straps.

From the foregoing summary it will be appreciated that it is an aspect of the present invention to provide a novelty wrist watch of the general character described which is not subject to the disadvantages of the background art aforementioned.

It is a further consideration of the present invention to provide a novelty wrist watch of the general character described which is durable, rugged and will withstand the rigors of sporting activities.

A further feature of the present invention is to provide a novelty wrist watch of the general character described wherein any of a number of compatible watch straps may be easily attached.

Another aspect of the present invention is to provide a novelty wrist watch of the general character described which provides a simple yet secure attachment between a watch strap and a watch case.

A further consideration of the present invention is to provide a novelty wrist watch of the general character described which is low in cost and suitable for economical low cost mass production fabrication.

Yet another feature of the present invention is to provide a novelty wrist watch of the general character described which includes a large, easily readable time display.

An additional consideration of the present invention is to provide a novelty wrist watch of the general character described having simplified assembly procedures.

A further aspect of the present invention is to provide a novelty wrist watch of the general character described having a low cost stylized plastic case which includes unitary molded plastic strap retainers spaced from the case and which are flexible to facilitate installation of a strap and the passage of a strap buckle or the like between the retainer and the watch case.

Other aspects, features and considerations of the present invention in part will be obvious and in part will be pointed out hereinafter.

With these ends in view, the invention finds embodiment in certain combinations of elements and arrangements of parts by which the aforesaid considerations, aspects and features are attained, all with reference to the accompanying drawing and the scope of which will be more particularly pointed out and indicated in the appended claims.

A BRIEF DESCRIPTION OF THE DRAWINGS

In the accompanying drawings in which is shown one of the various possible exemplary embodiments of the invention:

Figure 5:
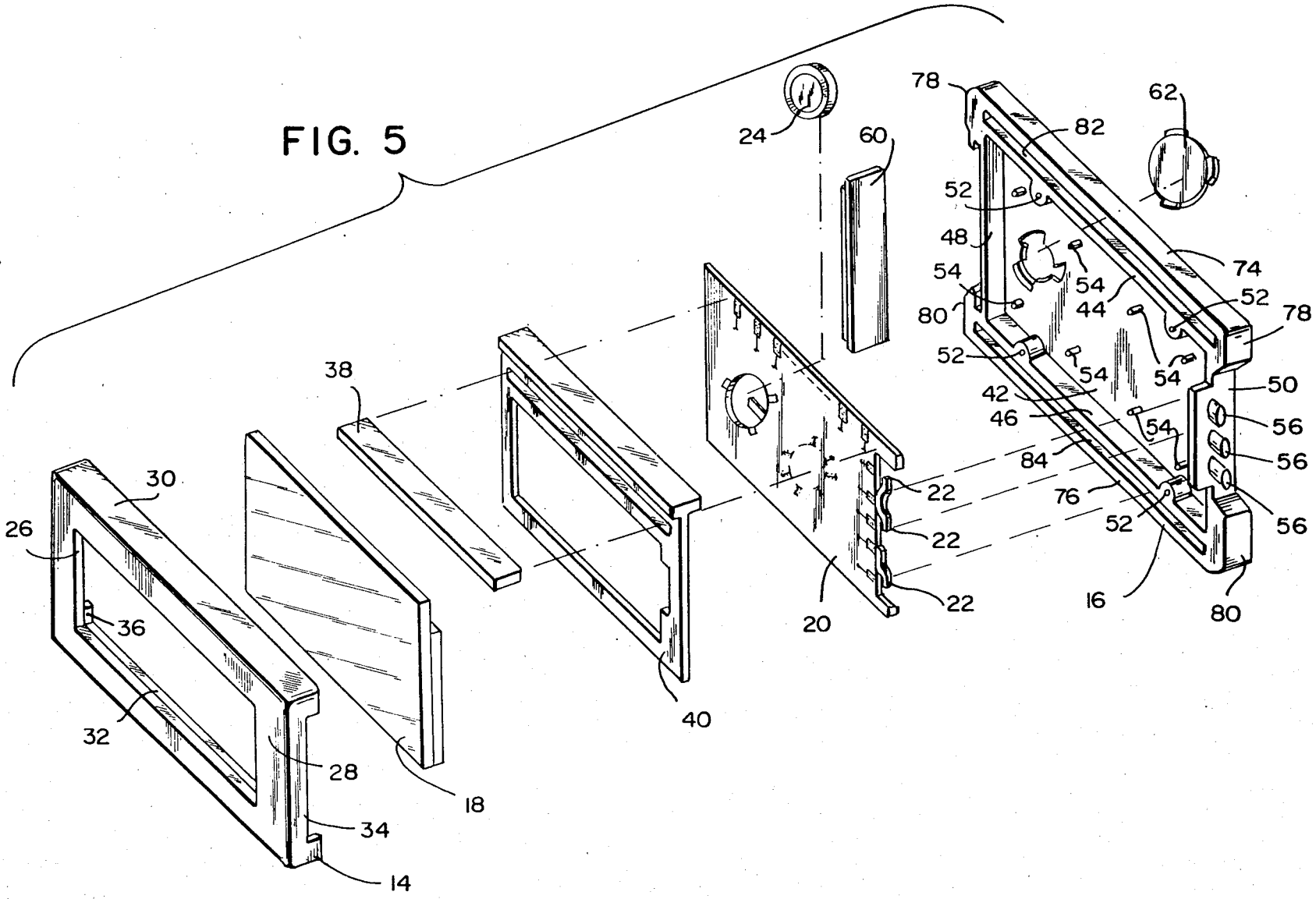

FIG. 5 an exploded view of the novelty watch, without the strap and showing the various components including an upper and a lower case section, a display, a circuit board and a power supply;

FIG. 6 is a plan view of the inside of the lower case section and showing the inside of the battery cover;

FIG. 7 is a sectional view through the lower case section, the same being taken substantially along the line 7—7 of FIG. 6 and more clearly illustrating a plurality of spacing pins; and FIG. 8 is an enlarged scale framentary sectional view through a side of the lower case section and more clearly illustrating a push botton for actuating a circuit board contact.

DESCRIPTION OF THE PREFERRED EMBODIMENT

Referring now in detail to the drawings, the reference numeral 10 denotes generally a novelty wrist watch constructed in accordance with and embodying the invention. The wrist watch 10 includes a two part molded plastic watch case 12 which is formed of an upper case section 14 and a lower case section 16 interfitted in a manner to be subsequently described. The watch case 12 carries a liquid crystal display 18 and a printed circuit board 20. The circuit board 20 includes conventional integrated circuit chips for clock timing and display driving. Different functions such as time and date setting, changing the display from time to date, second counting modes, etc., are actuated by a plurality of switch contacts 22 projecting from a side edge of the board 20. The board 20 also includes an aperture and suitable contacts which accommodate a conventional battery 24.

As previously mentioned, the display 18 is relatively large as compared with conventional wrist watches, having a width of approximately 4 cm. and a height of approximately 2 cm. The upper case section 14 receives and frames the display 18 within a rectangular cutout 26 formed in a top panel 28. Projecting perpendicularly from the longitudinal ends of the top panel 28 are a pair of end walls 30, 32 and projecting from the sides of the top panel 28 are a pair of side walls 34, 36. The upper case section 14 receives and carries the display 18 between the walls 30, 32, 34 and 36.

Referring now to FIG. 5 it will be observed that the display 18 is a conventional "jumbo" liquid crystal display and includes a pair of planar glass plates laminated together with one plate projecting beyond the top of the other plate. The inner face of the projecting plate includes a plurality of electrical contacts which are interconnected to associated contacts on the board 20 through a flexible gasket cushion 38 having discrete conducting zones associated with each of the display-board contact sets.

The display 18 and the gasket 38 are assembled in a display carrier 40 comprising a planar panel having a perpendicular head and a slot adjacent the head for accommodating the gasket 38. The smaller glass plate abuts the panel of the carrier 40. Positioned against the opposite side of the carrier panel is the board 20 with its electrical contacts engaging the gasket 38.

The lower watch case section 16 includes a generally planar bottom panel 42 and a pair of perpendicular end walls 44, 46. In addition, perpendicular side walls 48, 50 project from the sides of the bottom panel 42. A plurality of apertures 52 are formed in the panel 42 in registry with threaded apertures formed on the inner surface of the upper case section 14. Screws are employed to join the upper and lower watch case sections together through the apertures 52. A plurality of positioning pins 54 project from the inner surface of the panel 42 to contact the board 20 and urge complete electrical contact between the board 20 and the display 18 through the gasket 38.

In order to engage the watch function switch contacts 22 the lower case section side wall 50 includes a plurality of apertures registered with the contacts 22. Within each aperture is a pushbutton actuator 56 having enlarged outstruck ends for preventing dislodgement from the side wall 50. Projecting from the lower case side wall 48 are a pair of grooved tracks. A sliding access door 60 is received within the tracks and abutting the the side wall 46. The access door 60 projects above the height of the wall 48 to a height symmetrical with the side wall 50. The projecting portion of the access door is received in a cutout portion of the upper case section side wall 36. The access door 60 may be removed by sliding downwardly and provides simplified assembly and accessing a portion of the board 20 without disassembly of the watch case 12. For insertion and replacement of the battery 24, a circular aperture is formed in the bottom panel 42 of the lower case section and a disk closure 62 is provided.

As previously mentioned, a single piece watch strap 64 is secured to the watch case 12. The strap 64 is compatible in shape to the watch case 12 and would therefore be considered excessively wide as compared with conventional watch straps. The strap 64 includes a suitable fastener arrangement such as conventional snaps 66 which are engaged in mating sockets 68. Alternately, the strap 64 may have a buckle type fastener of exaggerated or enlarged size as compared with a conventional watch strap, more or less, on the order of the size of a belt buckle. A further strap fastener which may be used is a slide fastener. For styling appearance, the strap 64 may include three dimensional ornamentation such as studs 70 or simulated precious stones 72 suitably mounted in findings.

The strap 64 may be formed of a suitable sheet of a flexible plastic, synthetic rubber or like synthetic material or may even be formed of natural sheet materials such as leather. The strap is either cut from the sheet or is molded to the desired shape. Additionally, surface texturizing may be provided on the strap.

In order to attach the strap 64 to the novelty wrist watch 10 in a secure fashion while, at the same time, providing a simplified manner in which to substitute different straps, the present invention employs a pair of strap retainer bars 74, 76 associated with the end walls 44, 46 of the lower case section 16. Each strap retainer bar is generally straight and elongate, having a substantially rectangular cross section and is molded of one piece construction with the lower case section 16.

The strap retainer bars 74, 76 are maintained in spaced relation from the end walls 44, 46 by a pair of spacer links 78, 80 associated with the ends of the strap retainers 74, 76 respectively. The spacer links 78, 80 extend between the ends of the retainers 74, 76 respectively and the side walls 48, 50 of the lower case section 16. It will be observed that a generally elongate rectangular space 82 is provided between the strap retainer bar 76 and the end wall 44. Between the wall 46 and the bar 76 is a space 84.

Figure 1:
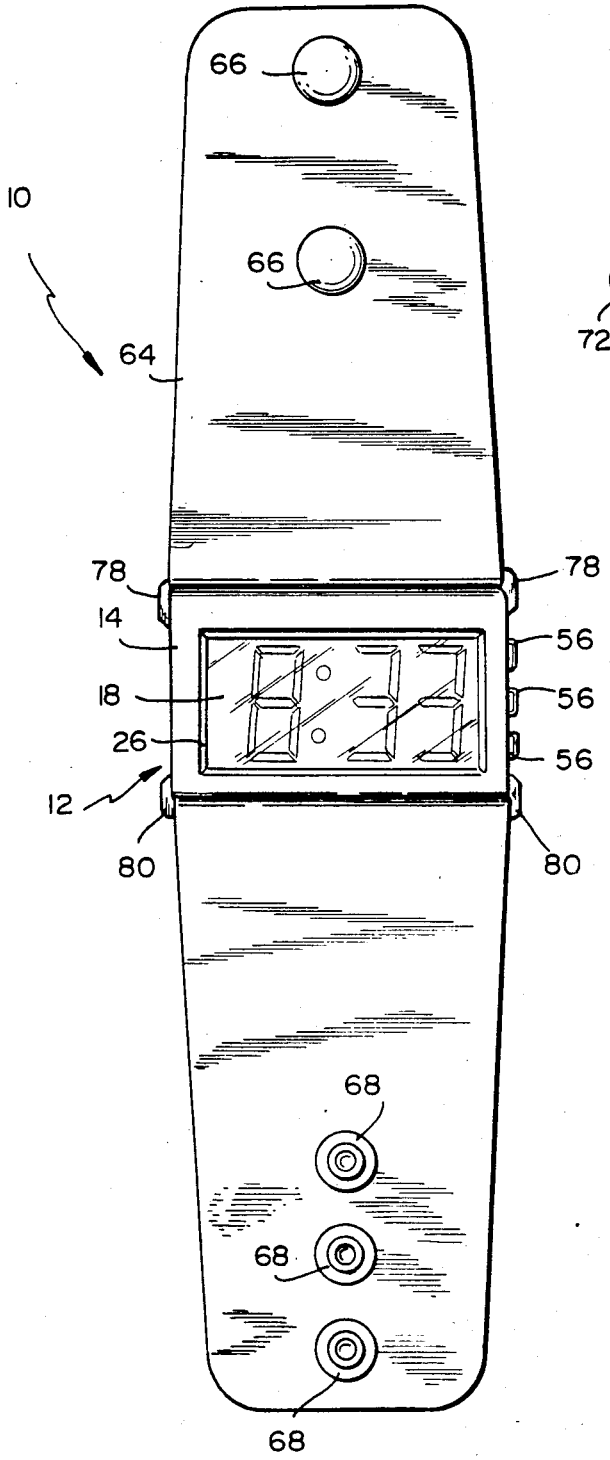
FIG. 1 is a plan view of a novelty wrist watch constructed in accordance with and embodying the present invention and showing a molded plastic watch case and a stylized watch strap secured to the case pursuant to the invention.
Figure 2:
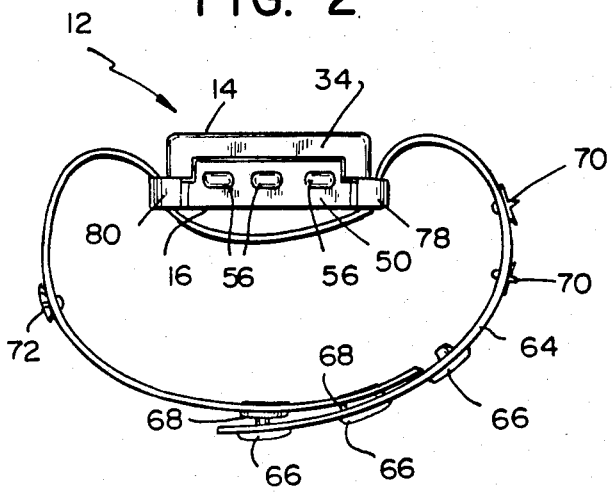
FIG. 2 is a side elevational view of the novelty wrist watch with the watch strap being closed and slackened to more clearly illustrate the manner in which the strap is looped between strap retainers and under the watch case.
Figure 3:
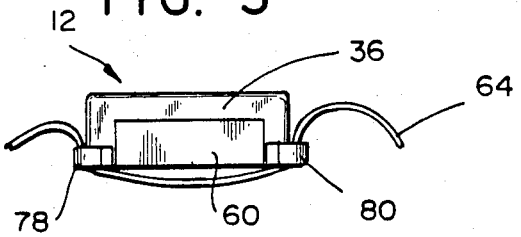
FIG. 3 is an elevational view of the novelty watch, similar to that of FIG. 2 but showing the opposite side and with portions of the strap being deleted.

Pursuant to the invention, the watch strap 64 is threaded into each of the spaces 82, 84, over each of the strap retainer bars 74, 76 and across the underside of the bottom panel 42 as illustrated in FIGS. 2 and 3.

Figure 4:
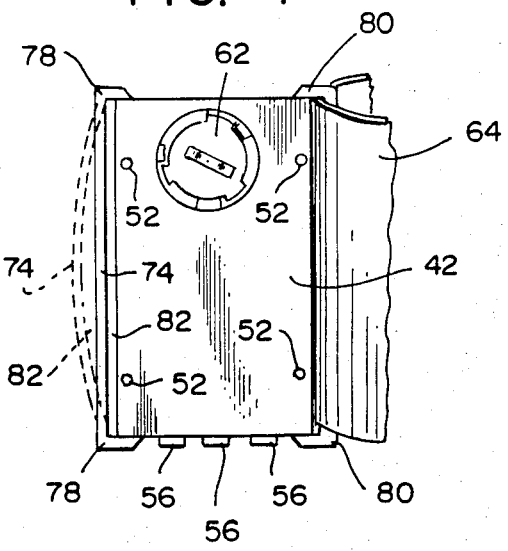
FIG. 4 is a bottom view of the novelty watch with one end of the strap being removed from engagement with a strap retainer and illustrating the bottom of the watch case including a battery cover.

Due to the nature of the plastic material of which the watch case is molded, e.g., ABS, polyethylene, polypropylene, polyamide, etc., and the elongate configuration of the retainer bars 74, 76. The retainer bars 74, 76 may be easily bent or deflected to permit the passage of watch strap fastener such as the snap fasteners 66 or sockets 68 as well as attached watch ornamentation such as the stud 70 and the simulated stone 72. Thus, the retainer bars may be medially deflected as illustrated in the dashed lines of FIG. 4 to enlarge the spaces 82, 84 and after the strap 64 and its snap fasteners and optional ornamentation have been threaded through the spaces 82, 84 the retainer bars 74, 76 are permitted to return to their molded positions.

Thus it will be seen that there is provided a novelty wrist watch which achieves the various features, aspects, and considerations of the present invention and which is well suited to meet the conditions of practical usage.

As various changes might be made in the novelty wrist watch as above set forth, it is to be understood that all matter herein described or shown in the accompanying drawings is to be interpreted as illustrative and not in a limiting sense.

Having thus described the invention it is claimed as new and desired to be secured by Letters Patent:

1. A novelty wrist watch comprising a molded plastic watch case, the watch case carrying a time display and a one piece watch strap, the watch case including strap retainer bars, the strap retainer bars being spaced from the ends of the watch case, the watch strap being positioned over one of the retainer bars and extending within a space between the one retainer bar and an end of the watch case and being positioned under the watch case and extending through a space between the other retainer bar and the other end of the watch case and extending over the other retainer bar, the retainer bars and the ends of the watch case being molded as an integral one piece unit, the watch strap including means for fastening the watch strap about a user's wrist, means mounting the fastening means to the watch strap, the fastening means being of a thickness greater than the space between the retainer bars and the ends of the watch case, each retainer bar including yieldable means for flexibly deflecting the retainer bar between the ends of the retainer bar to enlarge the space between the retainer bar and its watch case end to permit the watch strap with the fastening means to be inserted between the retainer bar and the end of the watch case.

2. A novelty wrist watch constructed in accordance with claim 1 wherein the case is formed of two sections, the retainer bars being molded in one piece with one of the sections, the one section including the ends of the case.

3. A novelty wrist watch constructed in accordance with claim 2 further including means for securing the two case sections together, the securing means comprising a plurality of screws extending from one case section to the other.

4. A novelty wrist watch constructed in accordance with claim 1 wherein the time display includes a jumbo digital display.

5. A novelty wrist watch constructed in accordance with claim 1 wherein the case has a width greater than its height.

6. A novelty wrist watch constructed in accordance with claim 5 wherein the case has a width approximately twice its height.

7. A novelty wrist watch constructed in accordance with claim 1 wherein the case is molded of acrylonitrile-butadiene-styrene.

8. A novelty wrist watch constructed in accordance with claim 1 wherein the watch strap is formed of synthetic rubber.

9. A novelty wrist watch constructed in accordance with claim 1 further, including a printed circuit board, the printed circuit board being carried in the case and power supply means, the printed circuit board being operatively connected to the display and to the power supply means.

10. A novelty watch adapted to be worn about a user's wrist, the watch comprising a molded plastic watch case, a time display, driving means for actuating the time display and energy storage means for powering thc driving means, the watch case carrying the display, the driving means and the energy storage means, the watch case further including two strap retainer means, each strap retainer means including a bar, means interconnecting the ends of each strap retainer means to the watch case and for maintaining the strap retainer means spaced from the watch case, the strap retainer means including yieldable means for flexibly deflecting the bar between its ends to enlarge the space between the strap retainer means and the watch case thereby permitting a watch strap to be inserted through the space between the strap retainer means and the watch case.

11. A novelty watch adapted to be worn about a user's wrist constructed in accordance with claim 10 wherein the watch case is formed of an upper and a lower section, the strap retainer means being molded in one piece construction with one of the sections.

12. A novelty watch adapted to be worn about a user's wrist constructed in accordance with claim 10 wherein the time display comprises a liquid crystal digital display.

13. A novelty watch adapted to be worn about a user's wrist constructed in accordance with claim 10 wherein the case is molded of acrylonitrile-butadiene-styrene.

14. A novelty wrist watch comprising a molded plastic watch case, the watch case carrying a time display and a one piece watch strap, the watch case including strap retainer bars, the strap retainer bars being spaced from the ends of the watch case, the watch strap being positioned over one of the retainer bars and extending within a space between the one retainer bar and an end of the watch case and being positioned under the watch case and extending through a space between the other retainer bar and the other end of the watch case and extending over the other retainer bar, the retainer bars and the ends of the watch case being molded as an integral one piece unit, the watch strap further including ornamentation means, the ornamentation means being thicker than the thickness of the watch strap, means for securing the ornamentation means to the watch strap, the retainer bars including yieldable means for flexibly deflecting the retainer bars between the ends of the retainer bars to enlarge the space between the retainer bars and the ends of the watch case, the enlarged space being sufficient to permit the ornamentation means to be inserted between the retainer bars and the ends of the watch case whereby a watch strap having ornamentation means may be inserted through the spaces between the retainer bars and the ends of the case.

15. A novelty wrist watch constructed in accordance with claim 14 wherein the case is formed of two sections, the retainer bars being molded in one piece with one of the sections, the one section including the ends of the case.

16. A novelty wrist watch constructed in accordance with claim 15 further including means for securing the two case sections together, the securing means comprising a plurality screws extending from one case section to the other.

17. A novelty wrist watch constructed in accordance with claim 14 wherein the time display includes a jumbo digital display.

18. A novelty wrist watch constructed in accordance with claim 17 wherein the case has a width approximately twice its height.

19. A novelty wrist watch constructed in accordance with claim 14 wherein the case is molded of acrylonitrile-butadiene-styrene.

20. A novelty wrist watch constructed in accordance with claim 14 wherein the watch strap is formed of synthetic rubber.

* * * * *